US011276296B2

(12) United States Patent
Hover

(10) Patent No.: US 11,276,296 B2
(45) Date of Patent: Mar. 15, 2022

(54) SAFE-WASH DEVICE

(71) Applicant: Robert A. Hover, Troy, MI (US)

(72) Inventor: Robert A. Hover, Troy, MI (US)

( * ) Notice: Subject to any disclaimer, the term of this patent is extended or adjusted under 35 U.S.C. 154(b) by 0 days.

(21) Appl. No.: 16/992,510

(22) Filed: Aug. 13, 2020

(65) Prior Publication Data

US 2022/0051545 A1 Feb. 17, 2022

(51) Int. Cl.
*G08B 21/24* (2006.01)
*G08B 7/00* (2006.01)

(52) U.S. Cl.
CPC ..... *G08B 21/245* (2013.01); *G08B 7/00* (2013.01)

(58) Field of Classification Search
CPC ..... G08B 21/245; G08B 7/00
See application file for complete search history.

(56) References Cited

U.S. PATENT DOCUMENTS 10,482,753 B2 * 11/2019 Nelson ..... G08B 21/245
2008/0170475 A1 * 7/2008 Simon ..... A63B 71/06 368/109
2015/0216369 A1 * 8/2015 Hamilton ..... A47K 5/1217 222/1
2018/0047277 A1 * 2/2018 Thyroff ..... G08B 21/24
2018/0221527 A1 * 8/2018 Riggio ..... A61L 2/16
2018/0308388 A1 * 10/2018 Kay ..... G08B 21/245
2019/0258449 A1 * 8/2019 Mudaliar ..... G11B 27/34
2020/0279472 A1 * 9/2020 Chinikar ..... E03C 1/055

* cited by examiner

*Primary Examiner* — Mohamed Barakat
(74) *Attorney, Agent, or Firm* — Harness, Dickey & Pierce, P.L.C.

(57) ABSTRACT

A safe-wash device to assist in washing hands at a handwashing station. The safe-wash device includes a housing, a sensor, a speaker, a display unit and a controller. The housing is mounted to a wall near or at the handwashing station. The sensor is disposed at least partially within the housing and is configured to detect movement of a user at the handwashing station. The speaker is disposed at least partially within the housing and configured to play music. The display unit is disposed at least partially within the housing and is configured to display a handwashing time period. The controller is in communication with the sensor, the speaker and the display unit. The controller is configured to activate the display unit and the speaker once the sensor detects movement of the user at the handwashing station.

20 Claims, 4 Drawing Sheets

SAFE-WASH DEVICE

FIELD

The present disclosure relates to a safe-wash device.

BACKGROUND

This section provides background information related to the present disclosure and is not necessarily prior art.

Washing hands is one of the most important ways to prevent the spread of germs, especially when out in public areas such as in restaurants or shopping centers, for example. The Centers for Disease Control and Prevention (CDC), for example, provides guidelines for effectively washing hands including scrubbing your hands for at least 20 seconds. The present disclosure provides a device that includes visual and audio features that assist a person in washing his or her hands for at least the minimum amount of time as recommended by the CDC. Furthermore, the present disclosure provides a device that allows for hands-free operation which maintains a safe, sanitary environment for the user washing his or her hands

SUMMARY

This section provides a general summary of the disclosure, and is not a comprehensive disclosure of its full scope or all of its features.

In one form, the present disclosures provides a safe-wash device to assist in washing hands at a handwashing station. The safe-wash device includes a housing, a sensor, a speaker, a display unit and a controller. The housing is mounted to a surface near or at the handwashing station. The sensor is disposed at least partially within the housing and is configured to detect movement of a user at the handwashing station. The speaker is disposed at least partially within the housing and configured to play music. The display unit is disposed at least partially within the housing and is configured to display a handwashing time period. The controller is in communication with the sensor, the speaker and the display unit. The controller is configured to activate the display unit and the speaker once the sensor detects movement of the user at the handwashing station.

In some configurations of the device of the above paragraph, a timer module is in communication with the controller and configured to set the handwashing time period.

In some configurations of the device of any one or more of the above paragraphs, the handwashing time period is at least 20 seconds.

In some configurations of the device of any one or more of the above paragraphs, the timer module is a toggle switch that allows the device to be set to one of a plurality of predetermined handwashing time periods.

In some configurations of the device of any one or more of the above paragraphs, the handwashing time period begins to countdown when the digital display unit and the speaker are activated.

In some configurations of the device of any one or more of the above paragraphs, the volume of the music gradually decreases as the handwashing time concludes.

In some configurations of the device of any one or more of the above paragraphs, the controller terminates the music and turns off the display unit once the handwashing time period ends.

In some configurations of the device of any one or more of the above paragraphs, an audio module in communication with the controller and configured to set the musical selection.

In some configurations of the device of any one or more of the above paragraphs, the audio module is a toggle switch that allows the device to be set to one of a plurality of musical selections.

In some configurations of the device of any one or more of the above paragraphs, a control system in communication with the controller and configured to control operation of the device remotely.

In another form, a method to assist in washing hands at a handwashing station is provided. The method includes detecting, using a sensor, movement of a user at the handwashing station; and activating, using a controller, a display unit and a speaker in response to the sensor detecting movement of the user at the handwashing station. Activating the display unit includes displaying a handwashing time period and activating the speaker includes playing a musical selection.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
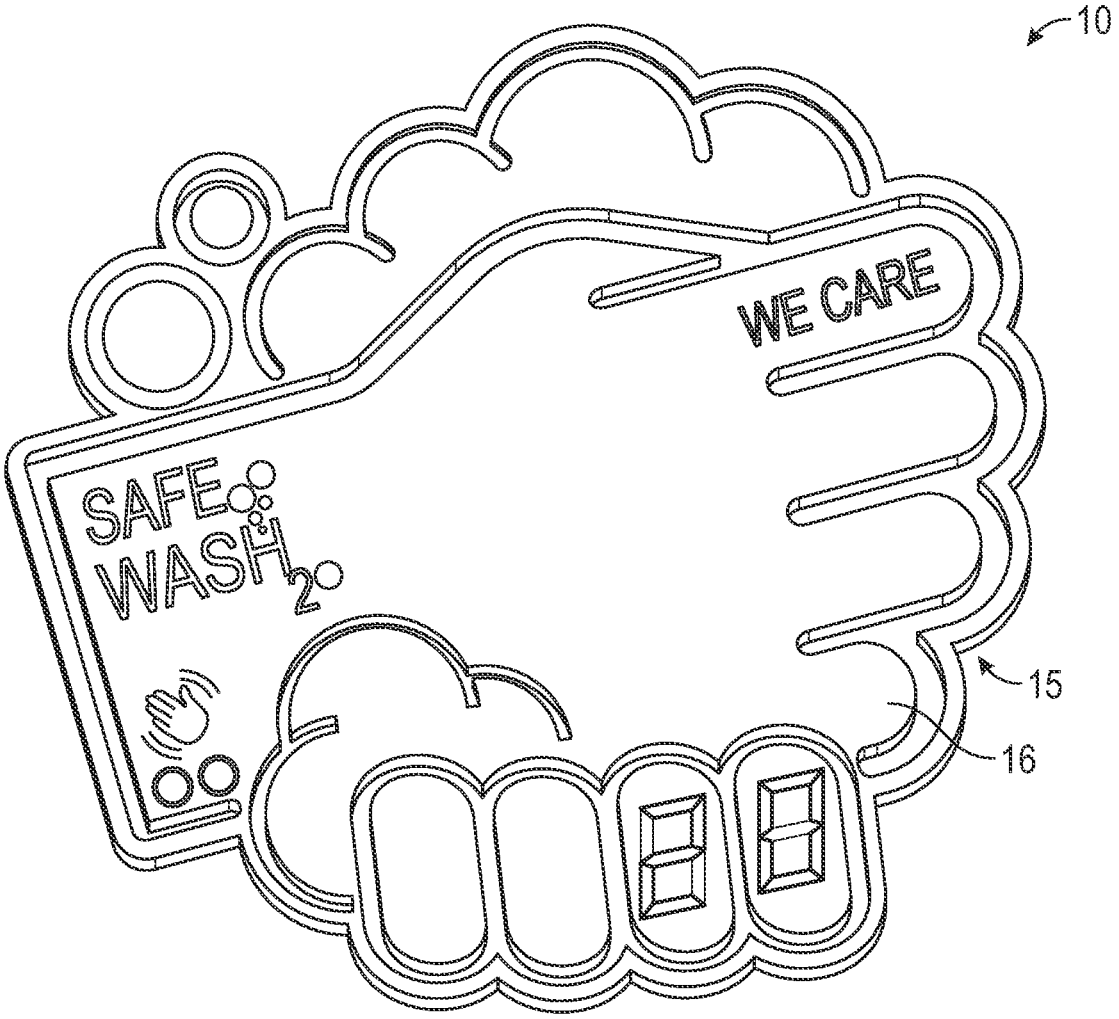
FIG. 1 is a perspective view of the safe-wash system in accordance with the principles of the present disclosure.
Figure 2:
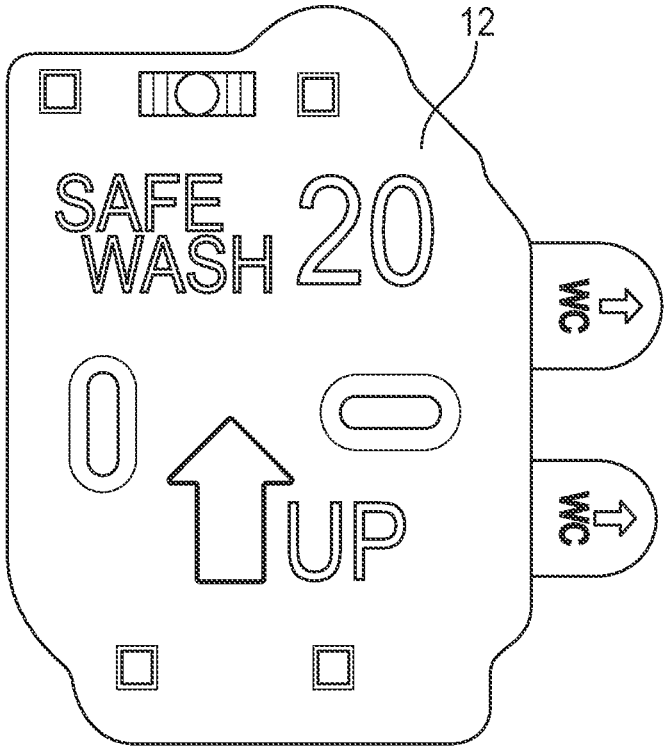
FIG. 2 is a front view of a mounting bracket of the safe-wash system of FIG. 1.
Figure 3:
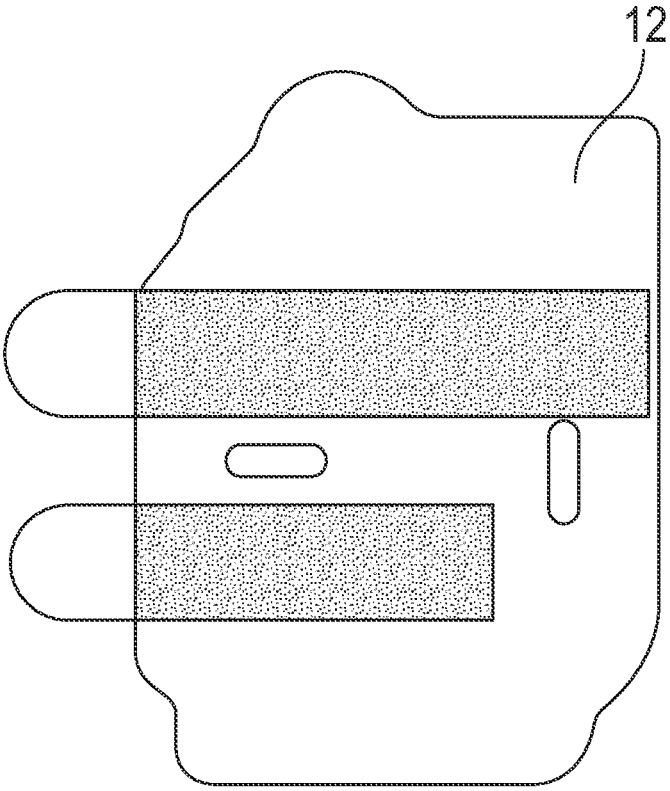
FIG. 3 is a back view of the mounting bracket of the safe-wash system of FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1, a safe-wash system 10 is provided. The safe-wash system 10 may be mounted to a wall in a bathroom (or kitchen), for example, of a building (e.g., restaurant, bar, office, home, etc.) and may assist to keep residents of the building healthy. For example, the safe-wash system 10 may facilitate handwashing of the residents of the building in compliance with safety standards. For example, in the United States of America, the Centers for Disease Control and Prevention (CDC) provides that everyone should wash their hands for a minimum of 20 seconds. The safe-wash system 10 provides audio and visual features that ensure that people who are washing their hands are doing so in compliance with the CDC minimum hand washing guidelines. It should be understood that the safe-wash system 10 is adjustable such that the system 10 can meet the handwashing guidelines of other countries also.

Figure 4:
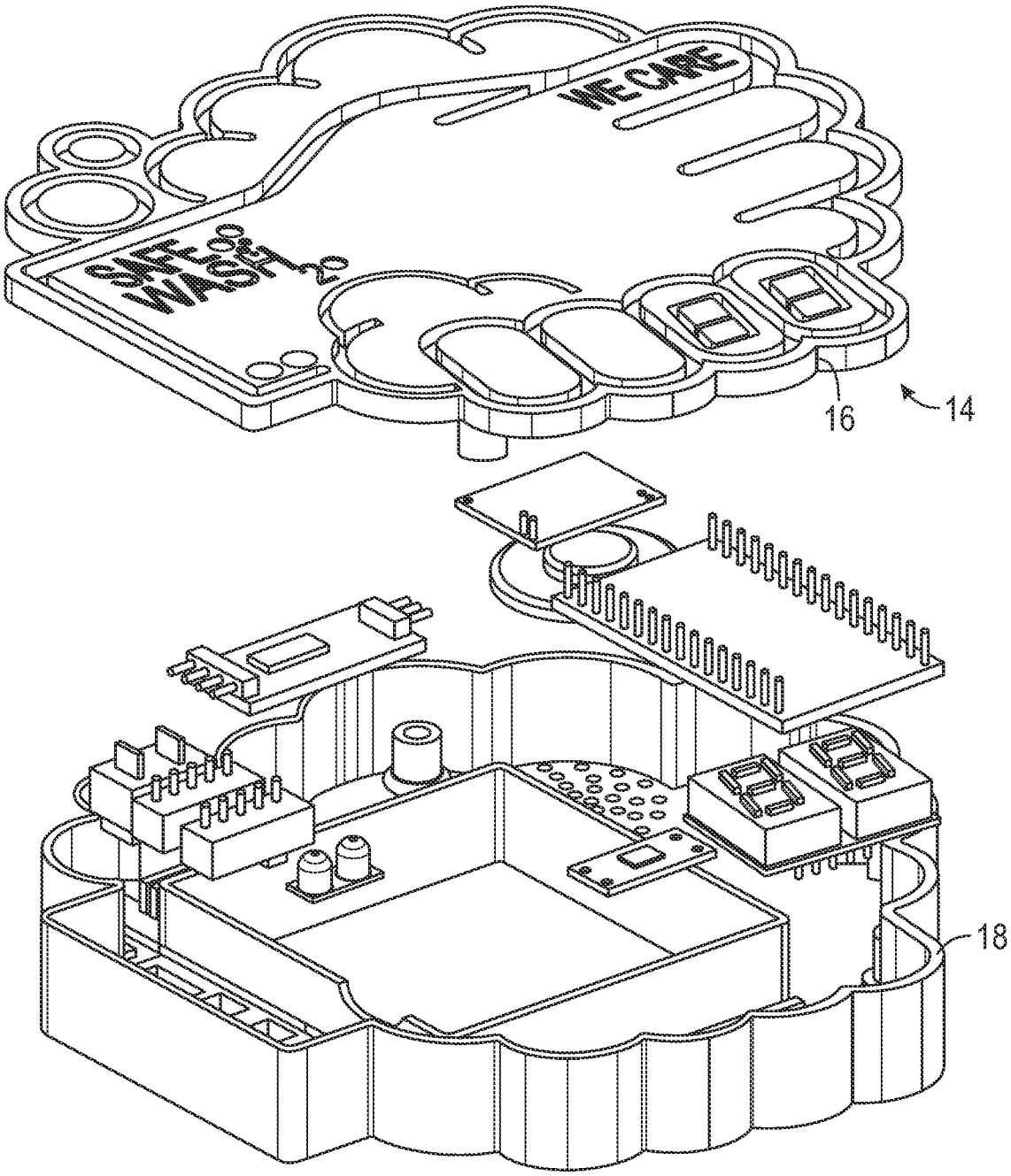
FIG. 4 is an exploded view of a safe-wash device of the safe-wash system shown in FIG. 1.

With reference to FIGS. 1-4, the safe-wash system 10 includes a wall mount 12 (FIGS. 2 and 3) and a safe-wash device 14 (FIGS. 1 and 4). The wall mount 12 may be mounted to the wall of the bathroom (or kitchen) and may be adjacent to a respective handwashing station (not shown). The wall mount 12 may be attached to the wall via fasteners (screws, bolts, etc.). In some configurations, the wall mount 12 may be attached to the wall via adhesive strips, in addition to, or instead of the fasteners. It should also be understood that the wall mount 12 may be mounted to a mirror, cabinet or any other suitable structure near the handwashing station.

The safe-wash device 14 snaps into engagement with the wall mount 12 such that the safe-wash device 14 is prevented from moving relative to the wall mount 12 (safe-wash device 14 is locked into place). As shown in FIG. 4, the safe-wash device 14 includes a housing 15 having a first casing 16 and a second casing 18 that are attached to each other to define an internal cavity that houses electrical components. For example, the first and second casings 16, 18 may house the controller 20, a memory card 22, a display unit 23, and a speaker 24, and may at least partially house a battery supply unit 26, a sensor 28, a power switch 30, a volume control 32, a timer module 34 and an audio module 36.

Figure 5:
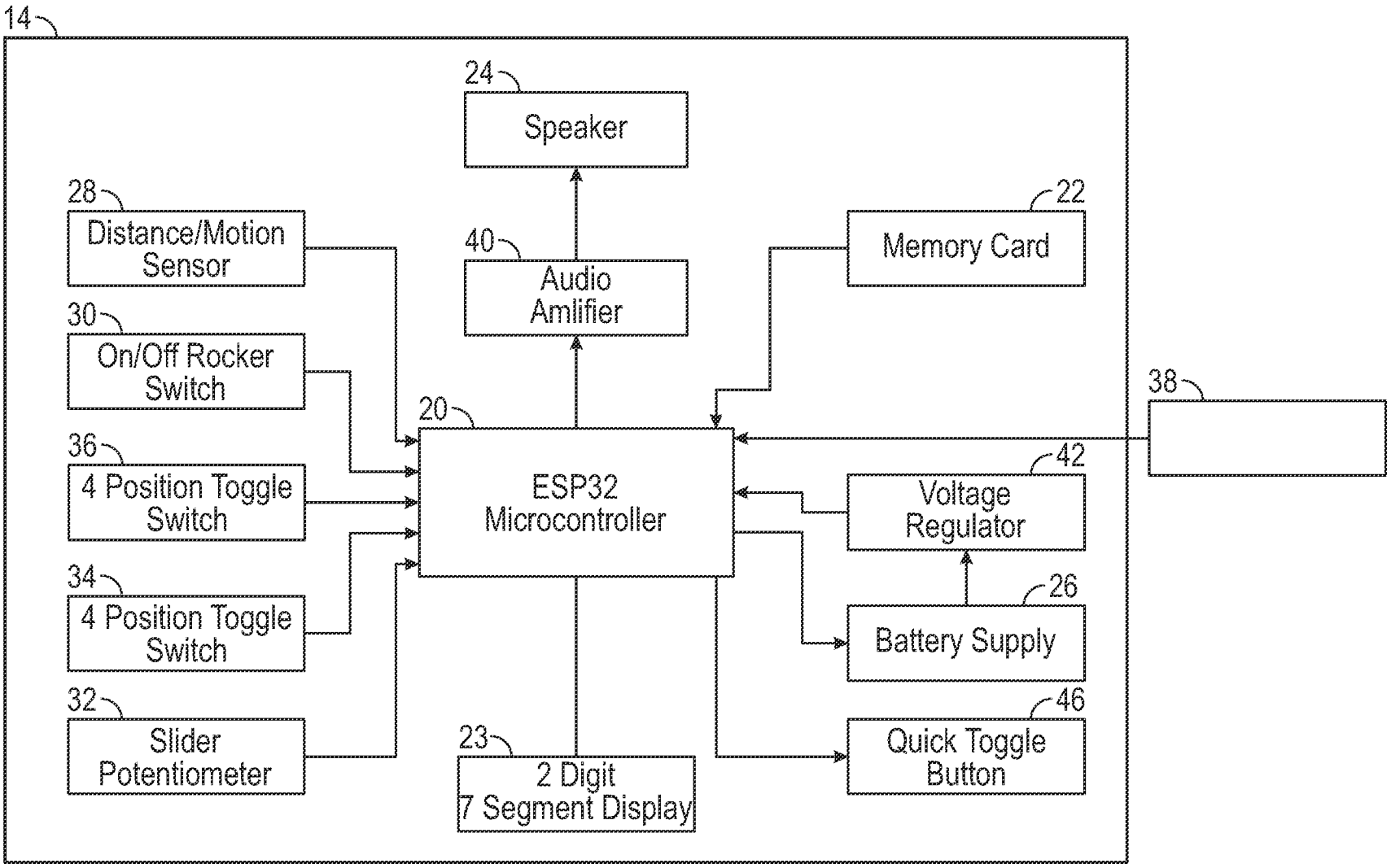
FIG. 5 is a functional block diagram showing components associated with the safe-wash device of the safe-wash system.

As shown in FIG. 5, the controller 20 is configured to execute instructions stored in a nontransitory computer-readable medium, such as a read-only memory ("ROM") and/or random-access memory ("RAM"). The controller 20 is in communication with the memory card 22, the display unit 23, the speaker 24, the battery supply unit, optional electrical wall plug 26, the sensor 28, the power switch 30, the volume control 32, the timer module 34, the audio module 36 and a control system 38.

The memory card 22 is in communication with the controller 20 and may store audio tracks to be played by the device 14. The display unit 23 is in communication with the controller 20 and may display the number of seconds in the countdown. The display unit 23 may include light-emitting diodes (LEDs) that display the number of seconds in the countdown. The controller 20 may activate the display unit 23 once the sensor 28 detects a user at the handwashing station. In this way, the user can keep track of the number of seconds remaining when washing his or her hands at the handwashing station. The user may visually view the countdown through the first casing 16 of the device 14, which ensures that the user is washing his or her hands for the appropriate amount of time. In one example, the display unit 23 may be a 2 digit, 7 segment display.

The speaker 24 may be in communication with the controller 20 via an audio amplifier 40 and may be a sound output for the music. Audio Amplifier 40 adjusts the sound volume from full volume to mute. The mute position is available when no sound is desired. The controller 20 may activate the speaker 24 once the sensor 28 detects a user at the handwashing station. In this way, the user can hear music when washing his or her hands at the handwashing station. The controller 20 may terminate the music through the speaker 24 once the time period has ended, thereby indicating to the user that the handwashing period has ended. This further ensures that the user is washing his or her hands for the appropriate amount of time. It should be understood that the music gradually fades as countdown on the display unit 23 gets closer to zero, which further indicates to the user that the handwashing period is about to end.

The battery supply unit 26 is in communication with the controller 20 via a voltage regulator 42 and may provide power to the device 14. The battery supply unit 26 may be accessible from the second casing 18 of the device 14. In this way, the battery supply unit 26 is hidden from view when the device 14 is coupled to the wall mount 12.

The sensor 28 (e.g., motion sensor, proximity sensor, etc.) may be in communication with the controller 20 and may detect when a user is near the handwashing station. Once the sensor 28 detects when a user is near the handwashing station, the sensor 28 sends a signal to the controller 20, which causes the controller 20 to activate the display unit 23 and the speaker 24 as described above. For example, the sensor 28 may use magnetic fields or a beam of light or electromagnetic radiation in order to detect movement near the handwashing station. When movement is detected, a change to the magnetic field or return signal occurs, which causes the sensor 28 to send a signal (wired or wireless) to the controller 20. In some configurations, the controller 20 may be in communication with a sensor (not shown) associated with a faucet (not shown) of the handwashing station that is in turn configured to turn the faucet to an ON mode. In such configurations, the sensor may send a signal to the controller 20 when the faucet is turned to the ON mode, which in turn, causes the controller 20 to activate the display unit 23 and the speaker 24 as described above.

The power switch 30 may be in communication with the controller 20 and may be moveable between an ON mode and an OFF mode. The volume control 32 may be in communication with the controller 20 and may be configured to control the volume of music played out of the speaker 24. In some configurations, the bathroom (or kitchen) may include multiple handwashing stations and multiple devices 14 associated with respective handwashing stations. In such configurations, the volume of each device 14 may be controlled via the respective volume control 32 such that the volume of the device 14 does not interfere with the other devices 14. The volume control 32 may be a slider potentiometer, for example.

The timer module 34 may be in communication with the controller 20 and may control the amount of time that the device 14 is in the ON mode (amount of time that the speaker 24 plays music for and the amount of time that the display unit 23 is set to count down from). The timer module 34 may be a four position toggle switch, for example, that allows the user to adjust the time between a plurality of predetermined times. For example, the timer module 34 may allow the user to adjust the time between 20 seconds, 30 seconds, 45 seconds, or 60 seconds. In this way, the user can be sure that he or she is washing their hands in accordance with the CDC guidelines of at least 20 seconds.

The audio module 36 may be in communication with the controller 20 and may control the music that the device 14 plays (the music that plays out of the speaker 24). The audio module 36 may be a four position toggle switch, for example, that allows the user to adjust the time between a plurality of predetermined musical selections. For example, the audio module 36 may allow the user to adjust the musical selections between three predetermined selections and a fourth selection that is uploaded to the device 14 via the control system 38. In this way, the user can upload their personalized business jingle or any other musical selection via the control system 38.

The control system 38 could be a computer, a mobile phone (e.g., smartphone), or a tablet, for example, or any other communication device or network of devices. The control system 38 may be in communication with the controller 20 via, for example, an internet, Wi-Fi, Bluetooth®, Zigbee®, power-line carrier communication (PLCC), or cellular connection or any other wired or wireless communication protocol. A user, using software application on the control system 38, may upload musical selections to the device 14, turn the device 14 between an ON mode and an OFF mode, control the volume of the device 14, and set the amount of time that the device 14 is in the ON mode for. In this way, the user can control the operational functions of the device remotely (without being in the bathroom or kitchen area, for example). In some configurations, a user, using the software application on the control system 38, may give a voice command to upload musical selections to the device 14, turn the device 14 between an ON mode and an OFF mode, control the volume of the device 14, and set the amount of time that the device 14 is in the ON mode for. An actuator 46 on the device 14 allows for pairing of the control system 38 to the device 14. The actuator 46 may be a toggle button, for example.

In some configurations, the device 14 may plug into an electrical outlet associated with the building instead of, or in addition to, being battery operated.

One of the benefits of the device 14 in the present disclosure is that the device 14 provides for hands-free operation which maintains a safe, sanitary environment for the user washing his or her hands.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In this application, including the definitions below, the term 'module' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "for."

What is claimed is:

1. A safe-wash device to assist in washing hands at a handwashing station, the device comprising:

a housing mounted to a wall near or at the handwashing station;

a sensor disposed at least partially within the housing and configured to detect a presence and movement of a user in proximity to the housing;

a speaker disposed at least partially within the housing and configured to play an audio selection;

a display unit disposed at least partially within the housing and configured to display a countdown of a handwashing time period;

a controller in communication with the sensor, the speaker, and the display unit, the controller configured to activate the display unit to display the countdown of the handwashing time period and to activate the speaker, in response to the sensor detecting the presence of the user in proximity to the housing; and a timer module in communication with the controller and configured to set the handwashing time period, wherein the countdown of the handwashing time period begins in response to the display unit and the speaker being activated, and a volume of the audio selection gradually decreases as the countdown of the handwashing time period decreases.

2. The device of claim 1, wherein the handwashing time period is at least 20 seconds.

3. The device of claim 1, wherein the timer module is a toggle switch that allows the device to be set to one of a plurality of predetermined handwashing time periods.

4. The device of claim 1, wherein the controller terminates the audio selection and turns off the display unit in response to the handwashing time period ending.

5. The device of claim 1, further comprising an audio module in communication with the controller and configured to set the musical selection.

6. The device of claim 5, wherein the audio module is a toggle switch that allows the device to be set to one of a plurality of musical selections.

7. The device of claim 1, further comprising a control system in communication with the controller and configured to control operation of the device remotely.

8. The device of claim 1, wherein the audio selection is music.

9. The device of claim 1, further comprising a memory card, and wherein the controller is in communication with the memory card.

10. The device of claim 9, wherein the musical selection is stored on the memory card.

11. A method to assist in washing hands at a handwashing station, the method comprising:

detecting, using a sensor, movement and presence of a user in proximity to the handwashing station;

activating, using a controller, a display unit and a speaker in response to the sensor detecting movement of the user in proximity to the handwashing station, wherein activating the display unit includes displaying a countdown of a handwashing time period and activating the speaker includes playing a musical selection, and wherein a volume of the musical selection gradually decreases as the countdown of the handwashing time period decreases.

12. A safe-wash device to assist in washing hands at a handwashing station, the device comprising:

a housing mounted to a wall near or at the handwashing station;

a sensor disposed at least partially within the housing and configured to detect movement of a user in proximity to the housing;

a speaker disposed at least partially within the housing and configured to play a musical selection;

a display unit disposed at least partially within the housing and configured to display a countdown of a handwashing time period;

a controller in communication with the sensor, the speaker, and the display unit, the controller configured to activate the display unit to display the countdown of the handwashing time period and to activate the speaker, in response to the sensor detecting the movement of the user in proximity to the housing; and a timer module in communication with the controller and configured to set the handwashing time period, wherein a volume of the musical selection gradually decreases as the countdown of the handwashing time period decreases.

13. The device of claim 12, wherein the handwashing time period is at least 20 seconds.

14. The device of claim 12, wherein the timer module is a toggle switch that allows the device to be set to one of a plurality of predetermined handwashing time periods.

15. The device of claim 12, wherein the controller terminates the musical selection and turns off the display unit in response to the handwashing time period ending.

16. The device of claim 12, further comprising an audio module in communication with the controller and configured to set the musical selection.

17. The device of claim 16, wherein the audio module is a toggle switch that allows the device to be set to one of a plurality of musical selections.

18. The device of claim 12, further comprising a control system in communication with the controller and configured to control operation of the device remotely.

19. The device of claim 12, further comprising a memory card, and wherein the controller is in communication with the memory card.

20. The device of claim 19, wherein the musical selection is stored on the memory card.

* * * * *